United States Patent [19]

Zayat, Jr. et al.

[11] Patent Number: 4,850,880

[45] Date of Patent: Jul. 25, 1989

[54] ANTI-TANGLE SWIVEL ELECTRICAL CONNECTOR

[76] Inventors: Charles D. Zayat, Jr., 100 New Hampshire St., Cranston, R.I. 02920; William R. Vincent, Wendy Dr., Scituate, R.I.

[21] Appl. No.: 127,180

[22] Filed: Dec. 1, 1987

[51] Int. Cl.[4] ..... H01R 39/00

[52] U.S. Cl. ..... 439/11; 439/9; 439/12; 439/13; 439/21; 439/24; 439/26; 439/638; 379/437; 379/438

[58] Field of Search ..... 439/9, 11, 12, 13, 18, 439/21, 23, 24, 26, 28, 29, 534, 638, 785, 786, 816, 823, 838, 864; 379/437, 438

[56] References Cited

U.S. PATENT DOCUMENTS

| | | | |
|---|---|---|---|
| 1,379,795 | 5/1921 | Allen | 439/22 X |
| 2,200,794 | 5/1940 | Krantz | 439/23 X |
| 2,414,957 | 1/1947 | Larrabure | 439/17 X |
| 3,005,173 | 10/1961 | Aske | 439/26 X |
| 3,089,113 | 5/1963 | Mohr | 439/17 |
| 3,105,728 | 10/1963 | Seeloff | 439/29 |
| 3,193,630 | 7/1965 | Daniels | 200/16 B |
| 3,396,586 | 8/1968 | Maclin et al. | 439/24 X |
| 3,416,121 | 12/1968 | Nealon | 439/26 X |
| 3,437,976 | 4/1969 | Nelson | 439/23 |
| 3,614,726 | 10/1971 | Richter | 340/853 |
| 4,061,381 | 12/1977 | Smal | 439/22 |
| 4,525,773 | 6/1985 | Hesse | 362/413 |
| 4,533,796 | 8/1985 | Engelmore | 439/24 X |
| 4,583,798 | 4/1986 | Blazowich | 439/24 |
| 4,592,605 | 6/1986 | Kapler | 439/17 |
| 4,673,228 | 6/1987 | Ditzig | 439/13 |
| 4,773,866 | 9/1988 | Basques | 439/21 |

FOREIGN PATENT DOCUMENTS

| | | | |
|---|---|---|---|
| 1042300 | 10/1953 | France | 439/13 X |

*Primary Examiner*—William L. Sikes
*Assistant Examiner*—Brian M. Healy
*Attorney, Agent, or Firm*—Spencer & Frank

[57] ABSTRACT

A device having two separate sets of contacts and a pivotal axis allowing 360° of rotational freedom between the two sets of contacts. The device is designed to provide the release of radial mechanical energy, stored in a coiled cord due to repeated twisting action, and imparted to the cord from the device attached to the cord. The device provides for continuous electrical connection between the two sets of contacts, by providing unique rotary contacts which allow interruption-free electrical continuity during the full 360° of rotation. The device provides for a minimal degree of friction, to allow for the rapid and thorough release of radial energy, and also provides minimum contact-wear, to allow for optimum electrical continuity and to provide for a long, useful life.

9 Claims, 6 Drawing Sheets

ANTI-TANGLE SWIVEL ELECTRICAL CONNECTOR

BACKGROUND OF THE INVENTION

The present invention relates to electrical connectors providing a plurality of contacts. More specifically, the present invention relates to electrical connectors which allow for 360° of rotation, while providing interruption-free electrical continuity.

Any device having a hand-held component, which is attached by a cord to the main base portion of the device, has a potential to develop a storage of radial mechanical energy in the cord due to repeated twisting of the cord and rotation of the hand-held device. Coiled cords utilized to connect portions of the device have an even greater tendency to accumulate and store radial energy and become twisted thereby. Devices, such as telephone handsets, microphones and headphones, are almost always equipped with coiled cords and are, therefore, either susceptible to twisting or tangling due to rotation of the devices. Further, computer keyboards and wired remote control devices are susceptible to repeated twisting motion which can lead to tangled cords.

All of these devices, and many other devices connected by cords, have a strong need for a simple, efficient and reliable means for releasing the twisting motion so that it does not become a store of radial energy. A device must be able to relieve the twisting energy as it is produced so that it does not accumulate and become a problem. The device must also be able to maintain continuous electrical continuity between the hand-held device and the base unit. A device which would solve the needs must also be reliable and able to suffer repeated twisting without any degradation in electrical signal carrying characteristics.

SUMMARY OF THE INVENTION

The present invention utilizes a center core member carrying one set of contacts rotatably mounted within an outer housing carrying complementary contacts. The core and housing members provide free rotation to avoid tangling. The construction taught in the present invention provides for interruption free signal continuity between the core and housing members. The mininal friction constructions taught by the embodiments described herein provide for extended connector life while maintaining the desirable signal continuity.

BRIEF DESCRIPTION OF THE DRAWINGS

A better understanding of the present invention will be obtained through a reference to the following detailed description, when taken in conjunction with the accompanying drawings, wherein like reference characters refer to like parts, throughout the several views, and in which:

FIGS. 9A–9E are views of a fourth alternative embodiment of the present invention.

DETAILED DESCRIPTION OF THE PREFERRED EXEMPLARY EMBODIMENTS

Figure 1:
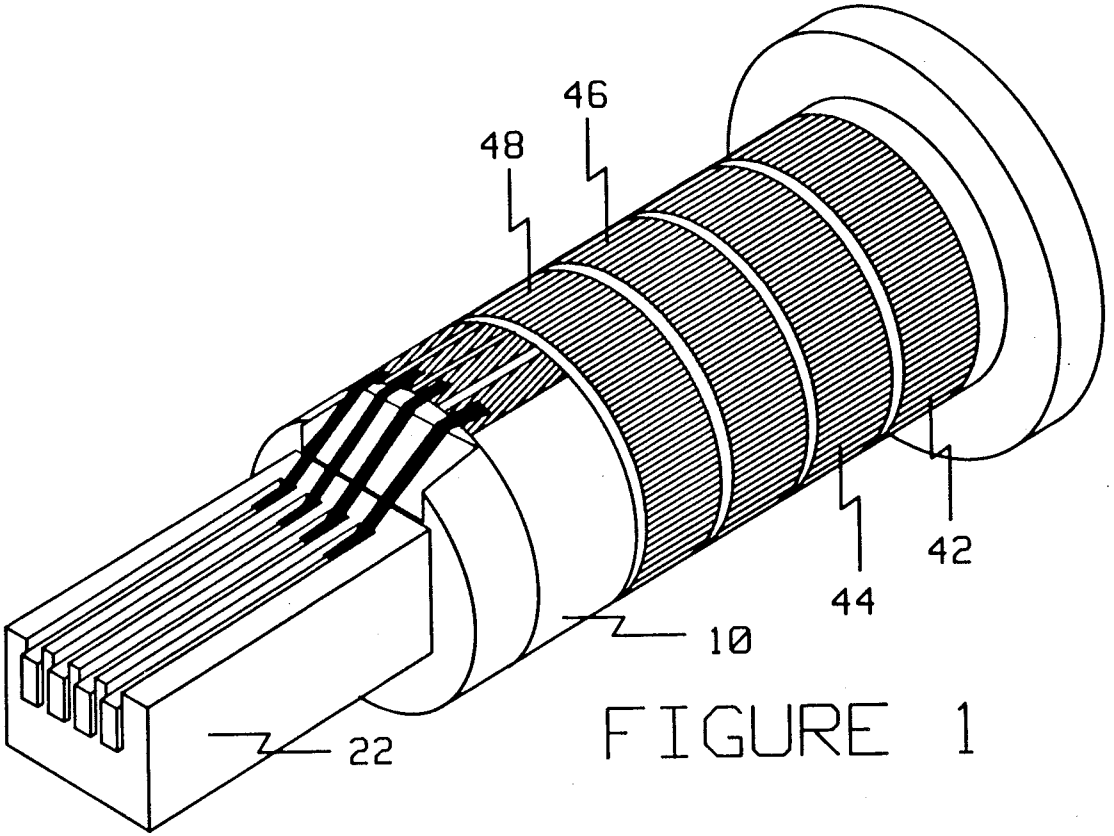
FIG. 1 is a perspective view of the central core portion of a first embodiment of the present invention.
Figure 2:
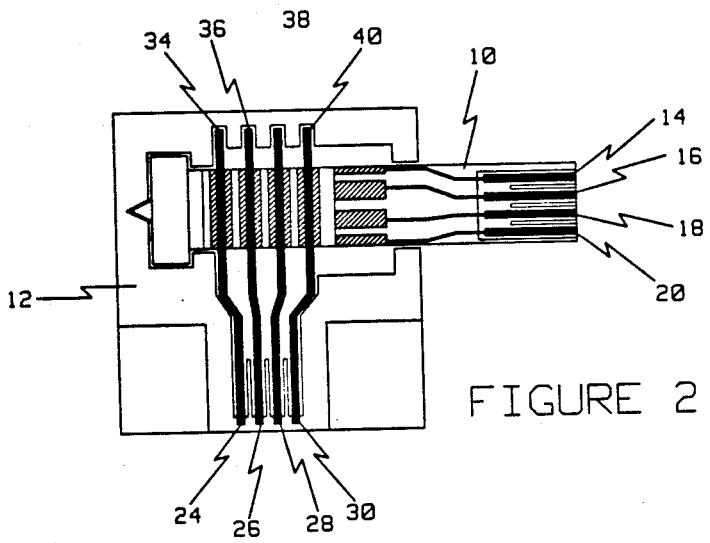
FIG. 2 is a top cutaway view, illustrating the central core portion of a first embodiment of the present invention situated in the outer shell portion.
Figure 3:
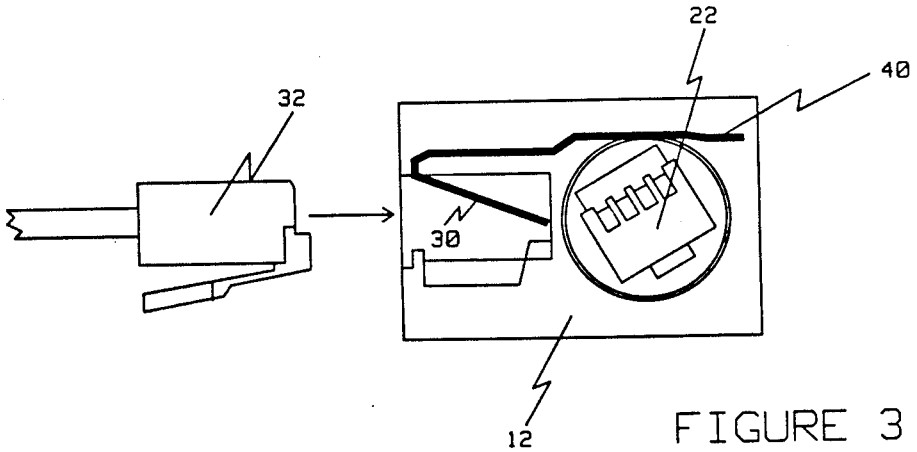
FIG. 3 is an end cross-sectional view of a first embodiment of the present invention, utilized in conjunction with a modular plug.

The first embodiment of the present invention, as illustrated in FIGS. 1–5, has a core portion 10 and a housing portion 12. Core member 10 has four electrical terminals 14, 16, 18 and 20 better illustrated in FIG. 2 which can form a modular plug 22, as better illustrated in FIG. 3. Terminals 24, 26, 28 and 30 of housing member 12 are configured for receipt of modular plug 32, as illustrated in FIG. 3.

The other ends of spring contacts 24–30 are formed into wiper contacts 34, 36, 38 and 40. Each of the wiper contacts 34–40 maintain electrical connection with one of the electrical strips 42, 44, 46 or 48 of central member 10. Wiper contacts 34–40 maintain contact with strips 42–48 through the spring-biased nature of the wiper contacts, urging them against the surface of the strips, such that they wipe across the strip surface and maintain electrical contact as core member 10 rotates within housing 12. Central member 10 is formed as illustrated in FIG. 4 from a core member 50, about which is wrapped tape 52 containing the electrical strips 42–48.

Figure 5A:
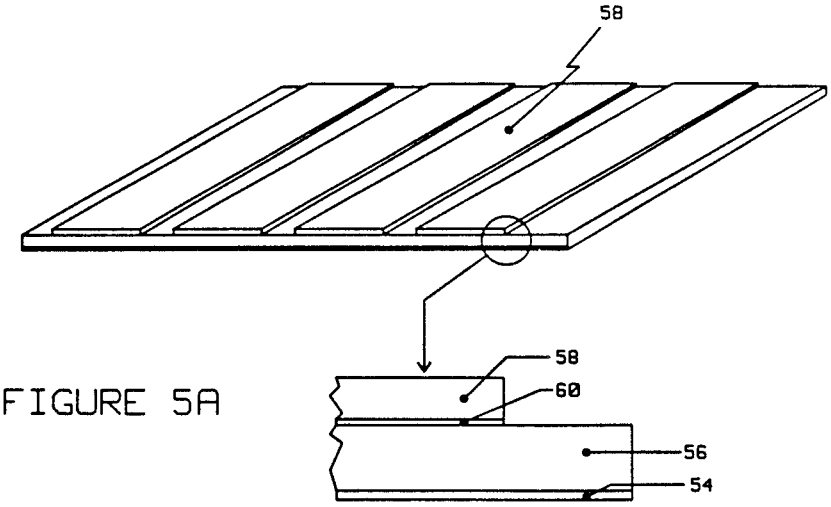
FIGS. 5A and B are detailed views of the tape and printed circuit utilized to construct the central core portion.
Figure 5B:
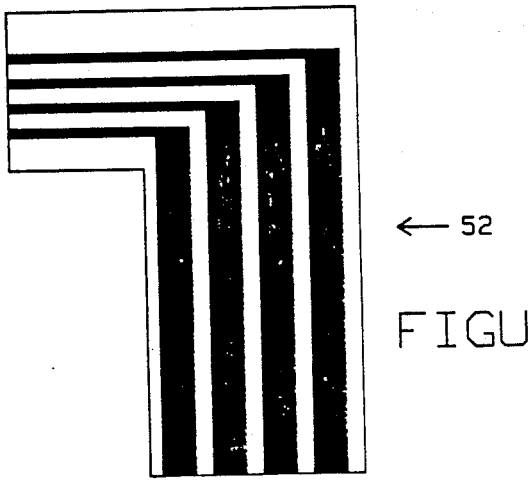

Tape 52, as illustrated in detail in FIG. 5, can be comprised of a first adhesive layer 54 attached to the underside of insulated substrate 56. A specific desired pattern of copper foil 58 is then bonded to the insulative substrate 56 by bonding region 60. Tape 52 with a copper foil pattern, as illustrated in FIG. 5B can be produced in this manner.

Figure 4:
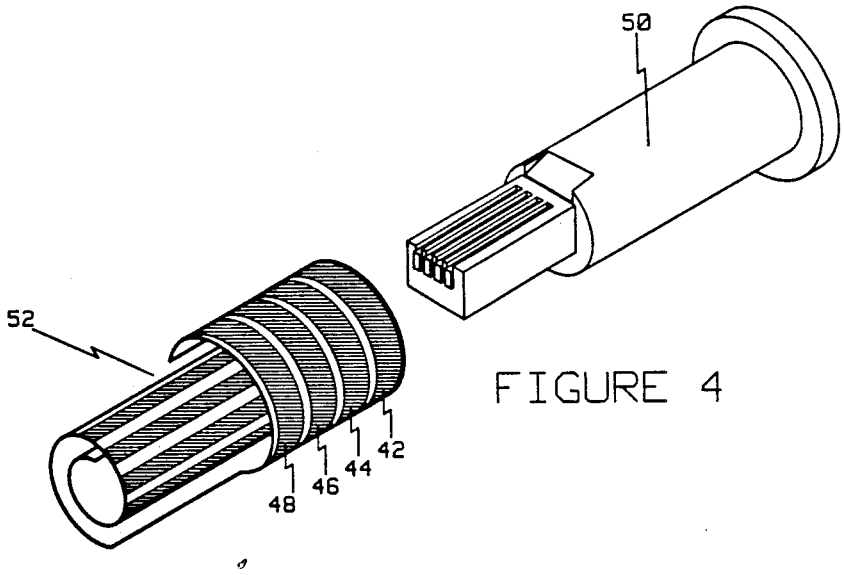
FIG. 4 illustrates the construction of the central core portion of a first embodiment.

As illustrated in FIG. 4, this tape 52 can then be wrapped about the core 50 and adhered thereto to provide the central member 10. Contacts 14, 16, 18 and 20 are then adhered to the electrical strips as illustrated in FIGS. 1 and 2, and are laid in their appropriate grooves in core 50 to form a modular plug end 22 of the central core member 10. Contacts 14–20 can be adhered to electrical strips 42–48 by soldering, braising or otherwise bonding in a manner that will form good electrical and mechanical contact.

The use of a continuous tape, as illustrated in FIG. 5B, which is comprised of an insulating substrate with a conductive pattern exposed on its upper surface, provides for an inexpensive method of mass-producing a connector in accordance with the teachings of the present invention. The method of construction of the center member 10, as illustrated in FIG. 4, is economical and reliable, while providing a durable and minimal-friction surface for associated wiper contacts.

An appropriately cut section of the tape 52 is easily and readily applied to the spool 50, in order to form the central portion of the first embodiment of the present invention.

Figure 6:
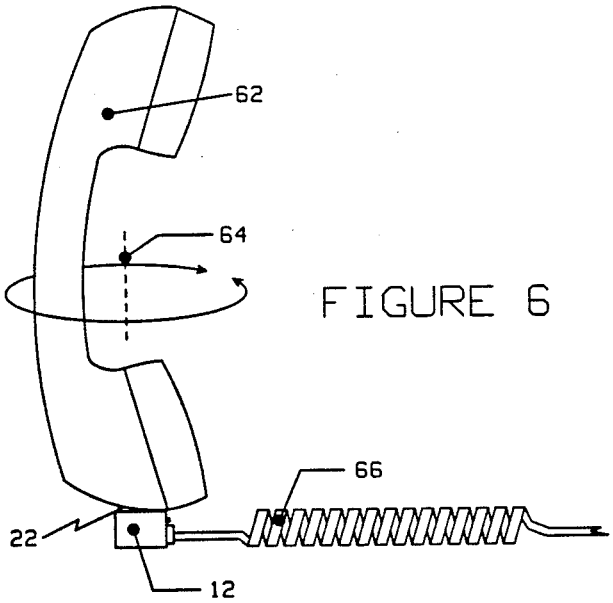
FIG. 6 illustrates the use of any of the embodiments of the present invention in conjunction with a telephone handset.

In FIG. 6 the modular plug 22 of the present invention is illustrated inserted into the modular socket of a standard telephone handset 62. The handset 62 rotates freely about axis 64 without imparting any twisting tension to phone cord 66.

In FIGS. 7–10, four further alternative embodiments of the present invention are illustrated. The external modular connections described in reference to the first embodiment can be used in a similar manner with the remaining embodiments to provide a swivel connector operable with a modular telephone handset. The modular socket and modular plug can be mounted at 90° angles relative to each other, as described above, to provide a connector having an input and output 90° opposed and rotating about each other. However, if it is more convenient or appropriate for the particular application, the modular plug and modular socket can be mounted along a common axis at opposite ends of the device FIG. 8A, or mounted at the same end of the device FIG. 9A. The final placement of the modular connectors is a matter of design choice and can be accomplished by simply providing a further bend in conductors 24–30, as illustrated in FIGS. 2A and 2B.

Also any form of connector can be utilized, the modular connector illustrated is only for the sake of example. Any form of plug, socket, clip, screw, mount or other connection type or design could be utilized as a matter of design choice.

Figure 7:
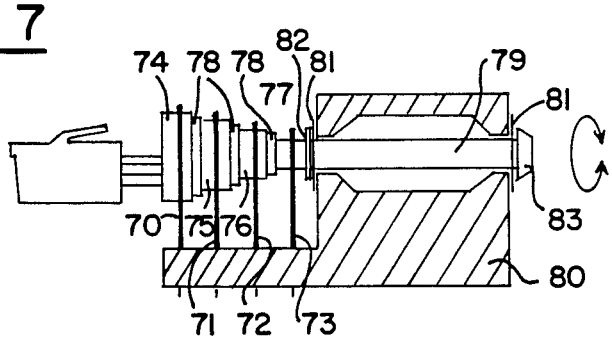
FIG. 7 is a side view of a second alternative embodiment of the present invention.

A second embodiment of the swivel connector, as illustrated in FIG. 7, incorporates a set of wipers 70, 71, 72 and 73 which maintain rotational contact with a set of metallic conducting cylinders 74, 75, 76 and 77, respectively. The metallic cylinders are spaced apart and maintained electrically isolated by insulating spacers 78. The unit is assembled by fitting the central axis 79 of the central rotating portion through the opening in housing 80 and attaching the appropriate nylon washers 81, and retaining clip 82 to axially secure the central member of the connector while allowing rotational movement between a central member and the housing 80. End cap 83 is also utilized to fasten the central member in position. Any desired form of connector 87 is built into housing 80 and attached to conductors 70–73. Similarly, any desired connector can be molded into the end of the central member at 84 and have different contacts attached to each of the conductive cylinders 74–77.

FIG. 8 illustrates a third alternative embodiment of the present invention, wherein the wipers are carried by the central member 85, and the stationery contacts surfaces are built into the exterior housing 86. Exterior housing 86 has a series of bands 87. 88, 89 and 90 of electrically conductive coating along the interior of the cylinder. Connection is made to these bands 87–90 by means of conductor strips 91 and 92 which run along the exterior of cylinder 86 and are connected to the bands 87–90 on the interior of cylinder 86 through holes passing through cylinder 86. The lead wires 93 attached to the conductors 91 and 92, can be extended as desired and terminated at an appropriate modular connector 94, as desired.

Wipers 95, 96, 97 and 98 carried by central member 85 brush along bands 87–90 as member 85 rotates within member 86. Wipers 95–98 can be shaped as illustrated in FIG. 8B so they travel smoothly while maintaining good electrical contact. Any shape providing good electrical contact biasing while allowing freedom of rotation is contemplated for the shape of wipers 85–89. A second modular connector 99 is provided for connection to the wiper arms 95, 96, 97 and 98.

Figure 8A:
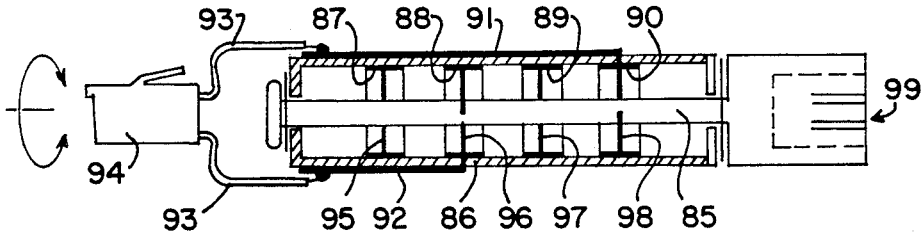
FIG. 8 is a side view of a third alternative embodiment of the present invention.
Figure 8B:
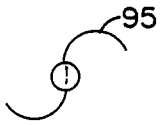
Figure 9A:
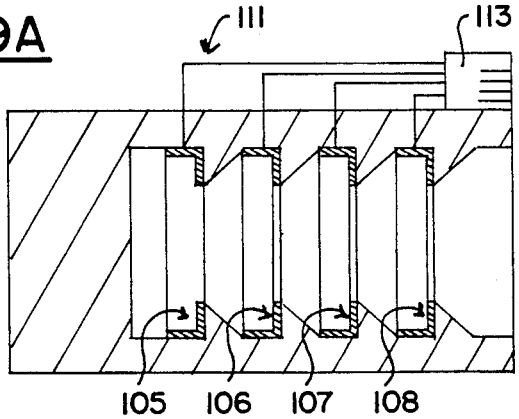
Figure 9B:
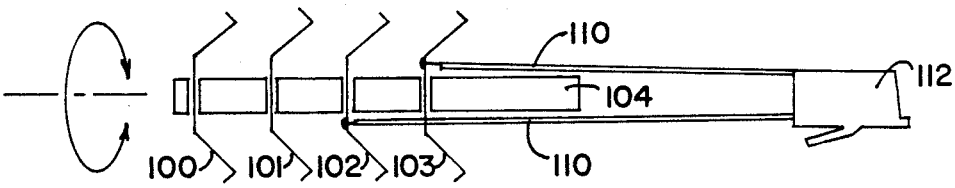

A fourth embodiment of the present invention, as illustrated in FIGS. 9A and B, is similar to the third embodiment of FIGS. 8A and B. In this fourth embodiment the wipers 100–103 are also carried on the central portion 104, and the conductive strips 105–108 are attached to the inner surface of outer housing member 109. The fourth embodiment does not utilize S-shaped conductors like 99, illustrated in FIG. 8B, but instead uses spring wipers 100–103, as illustrated in FIG. 9B. These wipers are urged against conductive ledges 105–108 by the spring forces of the wipers themselves.

Connections 110 are made to the wipers, as illustrated in FIG. 9B. Connections 111 are made to the conductive strips, as illustrated in FIG. 9A. These connectors 110 and 111 can terminate in any desired form of connector 112, 113, such as the modular connector illustrated and described above.

Figure 10A:
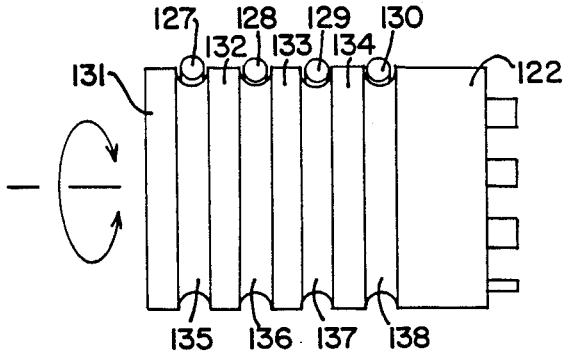
FIGS. 10A–E illustrate a fifth embodiment of the present invention.
Figure 10C:
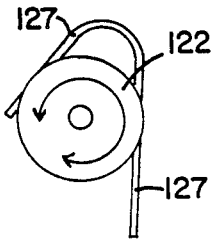
Figure 10E:
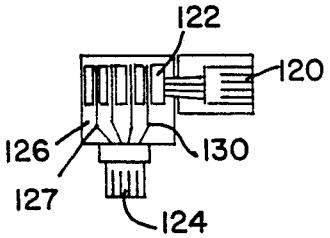
Figure 10B:
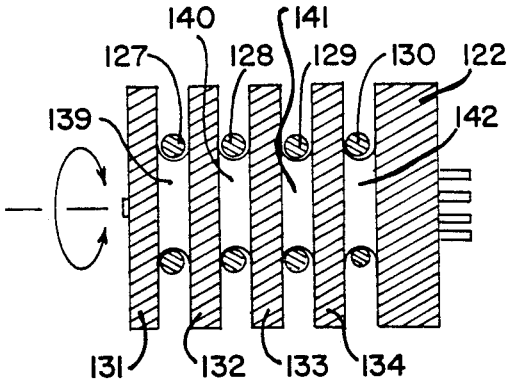
Figure 10D:
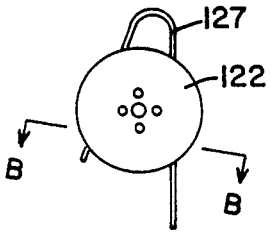

A fifth embodiment of the present invention is illustrated in FIGS. 10A–E. The overall configuration of the fifth embodiment, illustrating modular socket 120 attached to the central rotating portion of embodiment 122 and a modular plug 124 attached to the outer housing portion 126, is illustrated in FIG. 10E.

Leads 127–130 wrap around central portion 122, as illustrated in FIGS. 10C and D. Leads 127–130 make contact with the conductive portions of core member 122. The conductive portions are separated by insulators 131–134. The conductive members can be approximately the same diameter as the insulators, as illustrated by conductive members 135–138 in FIG. 10A. Alternatively, the conductor members can be of lesser diameter than the insulators, as illustrated by conductors 139–142 in FIG. 10B. Larger diameter conductors provide a greater contact area between the conductors and the leads. However, conductors of small diameter provide for better seating of the leads between the insulating members.

The preferred embodiments described herein illustrate a connector utilizing modular plugs and sockets, such as those standardly utilized in telephone handsets. These modular connectors contain four separate contacts for carrying appropriate signals. The device can be configured with any style of plug and/or socket combination for input and output of electrical signals, and can accommodate a lesser or greater number of connectors than the four illustrated as exemplary embodiment herein. The type and style of connecting plug and sockets, as well as the number of signal-carrying lines, is a matter of design for the particular application. Devices built in accordance with the teachings herein will perform and maintain electrical continuity throughout 360° of rotation with interruption-free characteristics.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

Once given the above disclosure, many other features, modifications and improvements will become apparent to the skilled artisan. Such features, modifications and improvements are thus to be considered a part of this invention, the scope of which is to be determined by the the following claims:

I claim:

1. An electrical connector, comprising;

a housing member, a core member pivotally connected to said housing member for rotational movement relative to said housing member, a contact strip carried on said core member, and a wiper carried by said housing member and biased toward contact with said contact surface, wherein said wiper maintains continuous contact with said surface as said core is rotated relative to said housing, and said core member is comprised of an essentially cylindrical base having a central axis, a first end and a second end adapted for seating in said housing to allow for rotation of said core about said axis, and a planar sheet having at least one "L" shaped contact strip having a first leg and a second leg mounted on one surface of said sheet.

2. The connector of claim 1, further comprising;

a plurality of wipers carried by said housing member, wherein said planar sheet has a plurality of said "L" shaped contact strips mounted on said one surface corresponding to said plurality of wipers.

3. The connector of claim 1, wherein;

said sheet is wrapped around said base such that said first leg of said "L" shaped strip forms an annular band about the circumference of said base, and said second leg extends along the surface of said base parallel to said axis of said base.

4. The connector of claim 2, wherein;

said sheet is wrapped around said base such that said first leg of each of said strips forms an independent annular band about the circumference of said base; and said second leg of each of said strips extends along the surface of said base parallel to said axis and isolated from each other strip.

5. The connector of claim 1, further comprising;

a first port connected to said housing, and a second port connected to said core member, said second port, having at least one conductor, and said first port having at least one conductor, wherein;

said conductor of said first port is connected to said wiper and said conductor of said second port is connected to said contact strip.

6. The connector of claim 4, further comprising;

a first multiconductor port, and a second multiconductor port, wherein;

each of said conductors of said first port is independently connected to one of said wipers, and each of said conductors of said second port is independently connected to one of said strips.

7. A twist prevention joint, comprising;

a housing, a core rotatably mounted to said housing, having a first cylindrical portion formed of an insulative core and a first conductive outer ring, a first conductive wiper connected to said housing and biased into contact with said first conductive outer ring, wherein said first conductive outer ring is connected to a first lead of a first external port attached to said core, and said first conductive wiper is connected to a fist lead of a second external port attached to said housing, a second cylindrical portion adjacent said first cylindrical portion, less than the diameter of said first cylindrical portion and having a dielectric core and a second conductive outer ring, a second wiper biased into contact with said second ring, wherein said first and said second rings are isolated from each other, said second ring is connected to a second lead of said first port, and said said second wiper is connected to a second lead of said second port.

8. The joint of claim 7, wherein said first and second ports are complementary multiple contact ports, each contact of said first port is connected to a separate conductive ring of said core, each contact of said second port is connected to a separate wiper, and complementary contacts of said ports are connected to a common interacting wiper and ring set.

9. A twist prevention joint, comprising;

a housing, a substantially cylindrical core comprised of a series of alternating conductive and dielectric disks each of said conductive disks having an annular groove about its circumference, a plurality of elongated wipers, corresponding in number to the number of conductive disks, attached to said housing, each of said wipers having a lateral cross-section of appropriate size and shape to seat in a corresponding one of said annular grooves, each of said wipers having a primary bend of lesser radius than said corresponding groove, and tangentially contacting said corresponding groove at a point along said wiper on each side of said bend.

* * * * *